US006484469B2

(12) United States Patent
Drake

(10) Patent No.: US 6,484,469 B2
(45) Date of Patent: Nov. 26, 2002

(54) COLUMN STRUCTURES AND METHODS FOR SUPPORTING COMPRESSIVE LOADS

(76) Inventor: William E. Drake, 3207 E. Calhoun Pkwy., Minneapolis, MN (US) 55408

( * ) Notice: Subject to any disclaimer, the term of this patent is extended or adjusted under 35 U.S.C. 154(b) by 0 days.

(21) Appl. No.: 09/982,296

(22) Filed: Oct. 16, 2001

(65) Prior Publication Data

US 2002/0046530 A1 Apr. 25, 2002

Related U.S. Application Data

(60) Provisional application No. 60/241,774, filed on Oct. 19, 2000.

(51) Int. Cl.[7] ..... E04H 12/34

(52) U.S. Cl. ..... 52/649.2; 52/115; 52/118; 52/301; 52/311; 52/727; 52/648.1; 52/649.1

(58) Field of Search ..... 52/649.2, 648.1, 52/649.1, 737.1, 736.3

(56) References Cited

U.S. PATENT DOCUMENTS

| | | | | |
|---|---|---|---|---|
| 706,189 A | | 8/1902 | Manlove | |
| 1,018,754 A | | 2/1912 | Ford | |
| 1,302,293 A | | 4/1919 | Blazer | |
| 2,035,662 A | * | 3/1936 | Maney | 29/446 |
| 2,689,025 A | * | 6/1954 | Yates | 182/141 |
| 2,857,755 A | | 10/1958 | Werth | |
| 3,153,789 A | | 10/1964 | Ashton | |
| 3,167,882 A | | 2/1965 | Abbott | |
| 3,232,638 A | | 2/1966 | Hollander | |
| 3,278,128 A | | 10/1966 | Szulc | |
| 3,382,627 A | | 5/1968 | Vartia | |
| 3,516,211 A | | 6/1970 | Rieve | |
| 3,538,653 A | | 11/1970 | Meckler | |
| 3,616,583 A | | 11/1971 | Weineck et al. | |
| 3,796,017 A | | 3/1974 | Meckler | |
| 3,851,485 A | * | 12/1974 | Steding | 222/154 |
| 3,916,594 A | | 11/1975 | Koehler | |
| 4,074,474 A | | 2/1978 | Cristy | |
| 4,155,207 A | | 5/1979 | Humphrey | |
| 4,267,676 A | | 5/1981 | Marchaj | |
| 4,313,287 A | | 2/1982 | Romig, Jr. | |
| 4,317,317 A | | 3/1982 | Kilts et al. | |
| 4,353,411 A | | 10/1982 | Harter et al. | |
| 4,409,764 A | | 10/1983 | Wilnau | |
| 4,685,253 A | | 8/1987 | Bitterly | |
| 4,776,370 A | | 10/1988 | Long, Jr. | |
| 4,912,901 A | * | 4/1990 | Jerry | 52/301 |
| 5,043,033 A | | 8/1991 | Fyfe | |
| 5,070,663 A | | 12/1991 | Sakai et al. | |

(List continued on next page.)

OTHER PUBLICATIONS

Hanes Supply, Inc., "Wire Rope 101," [online]; retrieved on Oct. 8, 2001 from the Internet: <URL:http://www.hanesupply.com/page1.html>, 4 pages.

*Primary Examiner*—Carl D. Friedman
*Assistant Examiner*—Basil Katcheves
(74) *Attorney, Agent, or Firm*—Mueting, Raasch & Gebhardt, P.A.

(57) ABSTRACT

A column assembly preferably includes a tube member having a wall that defines an interior volume. The column assembly is preferably operable to convert external, axial compressive forces applied to the column assembly into at least tangential stresses within the wall of the tube member. In one embodiment, an external compressive force causes increased pressurization of a filler material located within the volume of the tube member. The pressurized filler material produces tangential, tensile stresses within the wall of the tube member rather than axial compressive forces within the wall of the tube member. In some embodiments, a reinforcing, tension member, e.g., a wire rope, may be helically wound around the outer surface of the tube member along at least a portion of its longitudinal length.

23 Claims, 2 Drawing Sheets

U.S. PATENT DOCUMENTS 5,175,972 A * 1/1993 Sridhara ..... 52/737.4
5,230,436 A 7/1993 Vaughn
5,245,813 A 9/1993 Brotz
5,263,297 A 11/1993 Kim
5,327,694 A 7/1994 Gamel et al.
5,533,309 A 7/1996 Rivin
5,555,678 A 9/1996 Schoo
5,555,696 A 9/1996 Morrison, III et al.
5,692,351 A * 12/1997 Morrison et al. ..... 52/263
5,727,663 A 3/1998 Taylor
5,799,451 A 9/1998 Pilakoutas
5,850,713 A * 12/1998 Hojo ..... 52/115
5,899,044 A 5/1999 Jarrett
5,924,262 A 7/1999 Fawley
5,946,880 A 9/1999 Morrison, III et al.
5,960,597 A * 10/1999 Schwager ..... 242/160.2
6,146,576 A * 11/2000 Blackmore ..... 156/273.9

* cited by examiner

COLUMN STRUCTURES AND METHODS FOR SUPPORTING COMPRESSIVE LOADS

RELATED APPLICATIONS

This application claims the benefit of U.S. Provisional Application No. 60/241,774, filed Oct. 19, 2000, which is incorporated herein by reference in its entirety.

TECHNICAL FIELD

The present invention relates to load-supporting structures. More particularly, the present invention relates to columns and methods for supporting compressive loads via contained pressurization of a filler material within a column.

BACKGROUND

Compression members are subject to some of the same failure modes as tension members. For example, members loaded in compression along their centroidal axis will deform until the elastic limit of the material is reached at which point they may plasticly deform or fracture.

However, as the longitudinal length of the compression member increases relative to its cross-sectional dimension, the compression member becomes susceptible to a unique failure mode known as column buckling. Buckling is the result of various influences including material imperfections and variations, slight eccentricities or movements in the location of the compressive load, and other factors. While there is no clear point at which a compression member becomes subject to buckling failure, compression members having a length greater than about ten times their smallest cross sectional width may be analyzed for this failure mode.

A column can buckle quickly and without warning, severely weakening and possibly destroying the structure of which it supports. Accordingly, columns are typically designed such that the maximum anticipated loading will be less than the critical buckling load (the load at which buckling will occur).

To prevent buckling, the cross-sectional dimension of the column is typically sized to provide adequate buckling resistance. While effective, increasing the size of the column may result in a heavier and more costly member. Alternatively, secondary support structures may be used in conjunction with the column. For instance, with architectural structures, columns may be reinforced with lateral bracing to avoid the unsupported spans that may result in buckling failure. In other applications, the restraint method used to secure the column ends (e.g., fixed, guided, pinned) may be selected to provide greater buckling resistance. Another option is to avoid or minimize compressive failure by the use of less conventional structures, e.g., catenary suspensions. However, these alternatives may also result in more complicated, costly, and heavier structures.

The use of reinforced concrete columns is also known for construction/architectural applications. However, such columns often require on-site fabrication which may include the forming of molds and the placement of reinforcing rods. Thus, assembly time and expense may be significant.

One column apparatus that seeks to address buckling failure is found in U.S. Pat. No. 4,685,253 to Bitterly. Bitterly describes a pressure tube, which, in one embodiment, has a cable extending between its longitudinal ends. The cable is tensioned when the column is preloaded, i.e., pressurized by an external pressurization system. The internal pressure is reacted by hoop stress in the cylindrical wall of the tube. When compressive loads are placed on the Bitterly apparatus, it can support forces up to the corresponding preload without buckling.

While effective, some embodiments of Bitterly require the cable to prevent ejection of the piston from the tube during pressurization. Thus, in multiple column configurations, the length of the cable must be controlled to ensure each column apparatus has substantially the same overall length. Moreover, the ends of the cable must be adequately secured to prevent ejection of the piston.

Further, the pressure produced in the Bitterly column appears to be reacted mostly or entirely through tangential stress in the wall of the column. As a result, the wall thickness must be selected accordingly.

Another column apparatus is described in U.S. Pat. No. 5,555,678 to Schoo. Schoo uses a highly pressurized column wherein the internal pressure brings about internal longitudinal tensile stress. When the column is then subjected to an external compressive load, the resultant state of stress is described as the composition of both states considered independently, as deduced from the principle of superposition.

SUMMARY OF THE INVENTION

In one embodiment, a column assembly operable to support a compressive load is provided. The column assembly includes a tube member having a first longitudinal end and a second longitudinal end. A first endcap operable to substantially seal the first longitudinal end of the tube member is also provided as is a second endcap operable to substantially seal the second longitudinal end of the tube member. The second endcap may be longitudinally movable relative to the tube member. The tube member, the first endcap, and the second endcap enclose a volume. The column assembly further includes a filler material operable to substantially fill the volume, wherein application of the compressive load across the first endcap and the second endcap results in increased pressurization of the filler material.

In another embodiment, a column assembly for supporting a compressive load is provided where the column assembly includes a cylinder assembly. The cylinder assembly includes: a tube member having a longitudinal length and an outer surface; and at least one reinforcing member circumscribing at least a portion of the outer surface of the tube member. The column assembly may also include a first endcap adapted to substantially cover a first longitudinal end of the tube member and a second endcap adapted to substantially cover a second longitudinal end of the tube member. In some embodiments, the second endcap is longitudinally movable relative to the tube member. Preferably, the tube member, the first endcap, and the second endcap enclose a volume that may be filled with a filler material. The filler material is operable to convert at least a first portion of the compressive load into tangential stress within a wall of the tube member.

In still another embodiment of the invention, a method for supporting a compressive load is provided. The method includes providing a column assembly having a tube member with an outer diameter and a longitudinal length, the longitudinal length terminated by a first longitudinal end and a second longitudinal end of the tube member. The column assembly further includes a reinforcing member surrounding the outer diameter along at least a portion of the longitudinal length. A first endcap adapted to substantially cover the first longitudinal end of the tube member is also provided as is a second floating endcap adapted to substantially cover the second longitudinal end of the tube member. The tube member, the first endcap, and the second floating endcap preferably substantially enclose a volume. The method also includes filling the volume with a filler material. By then applying the compressive load between the first endcap and the second floating endcap, a pressure of the filler material within the volume is increased. The method also includes generating tangential stress in the tube member in response to the increased pressure of the filler material.

In still yet another embodiment of the invention, a cylinder assembly is provided that includes: a hollow tube member having a longitudinal length and an outer surface; and one or more reinforcing members circumscribing at least a portion of the outer surface between a first longitudinal end of the hollow tube member and a second longitudinal end of the hollow tube member.

The above summary of the invention is not intended to describe each embodiment or every implementation of the present invention. Rather, a more complete understanding of the invention will become apparent and appreciated by reference to the following detailed description and claims in view of the accompanying drawings.

BRIEF DESCRIPTION OF THE DRAWINGS

The invention described herein will be further described with reference to the drawings, wherein.

DETAILED DESCRIPTION OF EXEMPLARY EMBODIMENTS

In the following detailed description of the embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
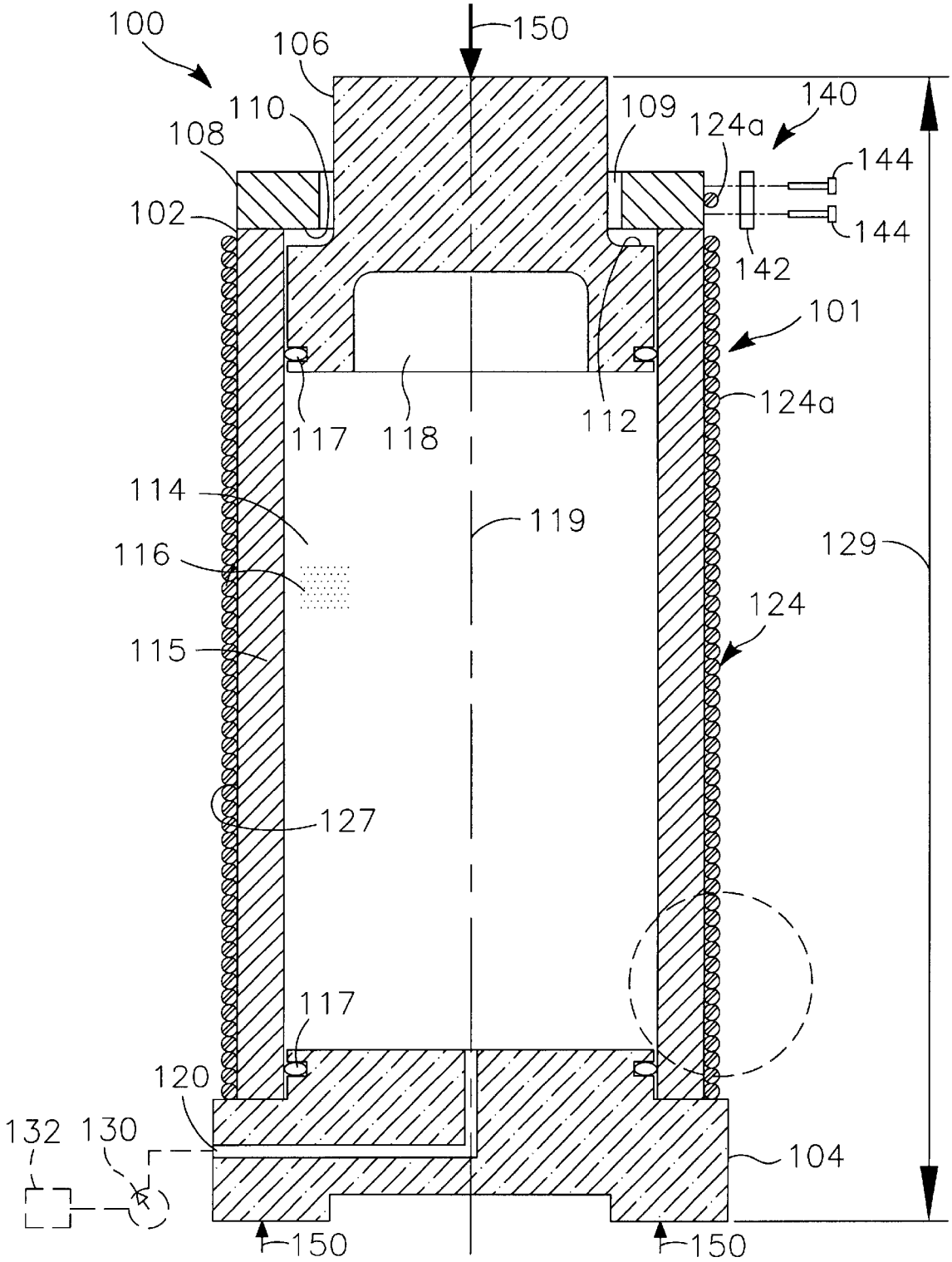
FIG. 1 is a cross-sectional view of a support member, e.g., column assembly, in accordance with one embodiment of the invention.

FIG. 1 illustrates a support member, e.g., column assembly 100, in accordance with one exemplary embodiment of the invention. The column assembly 100 preferably avoids or resists buckling failure by reacting the applied compressive loads as tangential, e.g., hoop, stresses in a wall 115 of the assembly 100. Tangential stresses, as known in the art, include stresses that act tangential to the wall 115 of the column assembly 100. By reacting the compressive loads in this manner, column assemblies in accordance with the present invention may substantially reduce the axial compressive stresses that typically produce buckling failure.

In some embodiments, the assembly 100 may further include one or more reinforcing members 124. The reinforcing member(s), described in more detail below, may carry a portion of the load that would otherwise be carried tangentially in the wall of the column assembly 100. Accordingly, the reinforcing member(s) 124 may allow a further reduction in overall size and weight of the column assembly 100 without a corresponding sacrifice in buckling threshold.

With this brief introduction, exemplary embodiments of the invention will now be described with reference to FIG. 1. Because the apparatus and methods of the present invention are relatively scalable, structural supports according to the present invention may find use in most any load-bearing application. For example, the potential load-carrying capacity of the assembly 100 may make it desirable for applications in aerospace, civil engineering/construction (e.g., buildings, bridges, elevated roads/railways), temporary or permanent platforms, and the like. However, these examples are not to be considered limiting as column assemblies constructed in accordance with the present invention may find use in most any column application, e.g., any application in which buckling failure is a concern.

The assembly 100 may include a cylinder assembly 101 which, in one embodiment, includes a cylindrical tube member 102 (also referred to hereinafter as tube 102). The tube 102 may be made from most any material, e.g., metal or plastic, that can withstand a predetermined internal pressure.

A first endcap 104 may substantially cover and preferably seal the opening formed at a first longitudinal end of the cylinder assembly 101 as shown. While not illustrated, the first endcap 104 may be fixedly secured to the cylinder assembly 101 via most any known method. For example, fasteners (not shown) may be used to screw or otherwise fasten the endcap to the cylinder assembly 101. Alternatively, both the first endcap 104 and the cylinder assembly 101 may include interengaging threads (also not shown). In still another embodiment, the first endcap "floats" as further described below.

Regardless of the retainment method used, the first endcap 104 preferably forms a seal with the cylinder assembly 101 through the use of one or more sealing elements 117, e.g., O-rings. The sealing element 117 is preferably substantially leakproof under various operating conditions and pressures.

A second endcap 106 may cover and preferably seal the opening formed in an opposing, second longitudinal end of the cylinder assembly 101. Like the first endcap 104, the second endcap 106 may also include one or more sealing elements 117. For reasons that will become apparent, the second endcap 106 preferably has the ability to "float" or move longitudinally relative to the tube member 102, e.g., float along the longitudinal axis 119 of the column assembly 100. While shown with only one floating endcap 106, other embodiments of the invention may include floating endcaps at both ends of the cylinder assembly 101, e.g., both endcaps 104 and 106 may float.

As those of skill in the art will recognize, one or both endcaps 104 and 106 may be individual components as shown or, alternatively, may be incorporated into the actual supported structure. For example, the endcap 106 may be integral with, or otherwise incorporated on, the structure (not shown) applying a compressive load 150 to the assembly 100 (see FIG. 1).

While the embodiment of the second endcap 106 illustrated in FIG. 1 and described above floats independently of the cylinder assembly 101, other "floating" endcap embodiments are also possible. For example, the endcap 106 may form a membrane or diaphragm (not shown) over the end of the assembly 101, e.g, a membrane attached to the second longitudinal end of the cylinder assembly 101. The membrane may deflect under load and pressurize a filler material 116 within the tube 102 (see discussion below). Accordingly, the term "floating endcap" may refer to most any endcap that permits, when the external compressive load 150 is applied, increased pressurization of the filler material 116 within the cylinder assembly 101 while, at the same time, substantially avoiding application of undesirable loads, e.g., compressive loads, to the cylinder assembly 101.

When assembled, the cylinder assembly 101, first endcap 104, and second endcap 106 define an enclosed volume 114 which, in one embodiment is accessible via a port 120 located in the first endcap 104. During use, the volume 114 is preferably filled with the filler material 116, e.g., a fluid, through the port 120. A bleed port (not shown) may be included on either the first endcap 104, second endcap 106, or the cylinder assembly 101 to assist in purging the volume 114 during filling.

In other embodiments, the volume 114 may be filled prior to installation of both endcaps, e.g., before installation of the second endcap 106, or, alternatively, through a port (not shown) located elsewhere such as on the second endcap 106.

Once filled, the port 120 may be sealed, whereby the filler material 116 is retained within the volume 114. In some embodiments, the volume 114 is filled to capacity but is not generally pressurized. That is, the filler material 116 is not pressurized beyond what is minimally required to adequately extend the endcap 106 and ensure uniform filling of the volume 114. In other embodiments, the filler material 116 may be pressurized to a predetermined level before use.

While the particular filler material 116 used to fill the column assembly 100 may vary, high-viscosity, petroleum-based liquids (e.g., hydraulic fluids) are preferable to reduce leakage and minimize corrosion. However, the particular filler material 116 should be selected based upon compatibility with the surrounding components and upon specific application parameters, e.g., high temperature applications would utilize a filler material able to withstand the maximum temperatures expected.

The term "filler material," as used herein, may preferably include not only incompressible liquids, but also other materials that provide liquid, fluid-like properties (e.g., an ability to flow and relatively high incompressibility). For instance, granulated solids such as fine sand may be appropriate as filler material in some embodiments of the invention. In fact, the different flow characteristics of granulated solid particles, as well as their response to an external compressive load, may be beneficial over liquid filler materials in some applications.

Figure 4:
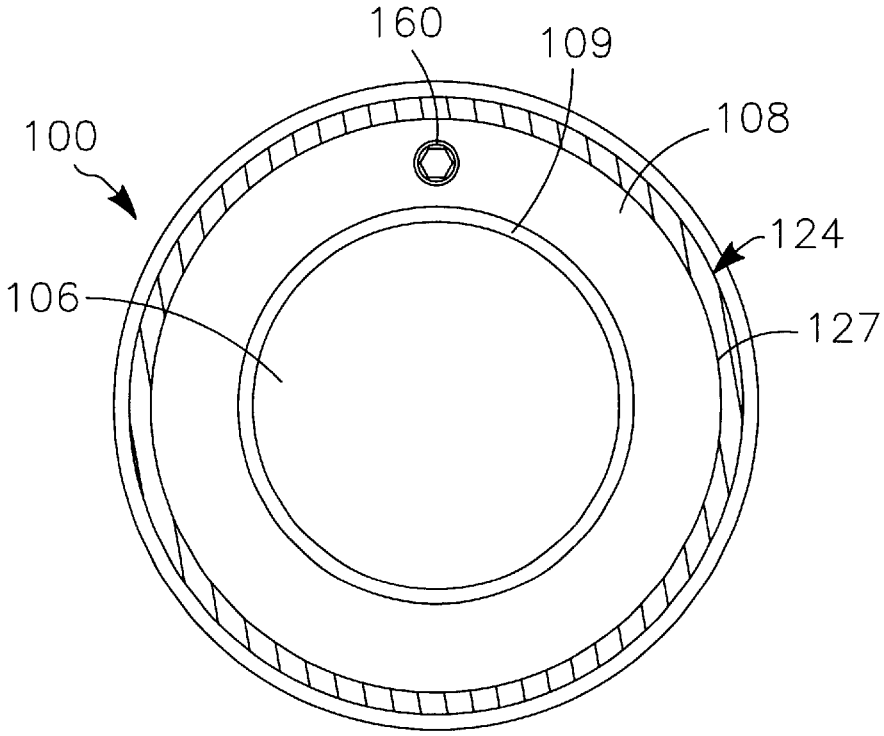
FIG. 4 is a partial top plan view of the column assembly of FIG. 1 with some items, e.g., anchoring device, removed for clarity.

Optionally the column assembly 100 may include a stop member 108 as also shown in FIG. 1. The stop member 108 may form a ring which attaches to the tube 102, e.g., screws or welds thereto, and has an opening 109 that allows the floating endcap 106 to pass therethrough. FIG. 4 illustrates one embodiment wherein multiple screws 160 (only one shown for illustration purposes) may be used to secure the stop member 108 to the tube 102, e.g., screws 160 may pass through the stop member 108 and thread into the tube.

When the second endcap 106 is fully extended, a surface 110 on the stop member 108 contacts a corresponding surface 112 on the second endcap 106. Once the surfaces 110 and 112 contact, further extension of the second endcap 106 relative to the cylinder assembly 101 is prevented. Accordingly, the maximum distance 129 between endcaps 104 and 106 may be controlled.

As discussed above, the cylinder assembly 101 may include the optional reinforcing member(s) (generically identified in the Figures by reference numeral 124) that surrounds, e.g., circumscribes, at least a portion of the outer surface 127 of the tube member 102. Where the tube 102 is circular in cross-section, an outer diameter of the tube forms the outer surface 127, see e.g., FIGS. 1 and 4.

In one embodiment, the reinforcing member may be a wire rope 124*a* or cable that is helically wound around the outer surface 127 along a substantial portion of the longitudinal length of the tube 102. "Wire rope," as known in the art, may include a core material e.g., a wire, helically wrapped by wire strands wherein each wire strand is made up of numerous individual wires. By controlling the maximum diameter of the wire rope 124*a*, more uniform contact between the wire rope and the tube member 102 may be obtained.

Preferably, the reinforcing member 124 is tightly wound and pretensioned. Accordingly, the reinforcing member, e.g., wire rope 124*a*, may be anchored at each end with an anchoring device 140 (only one device 140 shown in FIG. 1) or by other similar methods. The anchoring device 140 may secure the wire rope 124*a* between a clamp member 142 and the column assembly 100, e.g., the tube 102 or the stop member 108 (latter illustrated). Fasteners 144 may be provided which pass through the clamp member 142 and thread into the column assembly 100, e.g., into the stop member 108, to secure the wire rope 124*a* relative to the tube member 102.

In other embodiments, the wire rope 124*a* may be secured by welding or by other methods known in the art. By adequately tensioning and anchoring the wire rope 124*a*, expansion of the tube member 102 resulting from the increased tangential stresses in the wall 115 may be at least partially restrained by tensile stress in the helically-wound wire rope 124*a*. That is, the compressive load 150 applied longitudinally to the column assembly 100 may be at least partially reacted by tensile stress in the reinforcing member 124.

Figure 2:
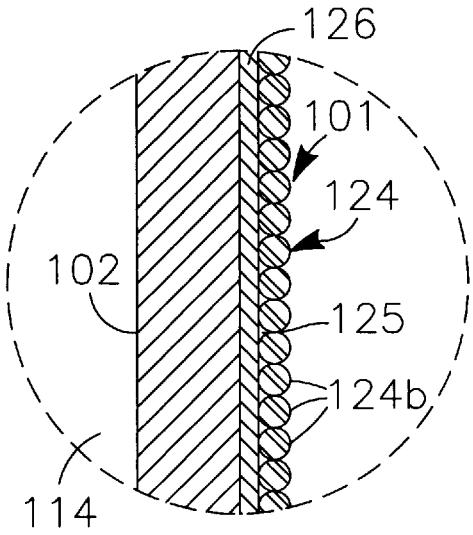
FIG. 2 is a partial, enlarged cross-sectional view of a portion of a column assembly in accordance with another embodiment of the invention.

While described above as utilizing a single wire rope 124*a* helically wound around the tube 102 and secured at opposite ends of the tube member 102, other embodiments of the invention may use a reinforcing member consisting of individual endless ring members 124*b* (see FIG. 2). These ring members 124*b* may form wire or wire rope "bands." While illustrated only in a partial view in FIG. 2, the entire cylinder assembly 101 utilizing the ring members 124*b* may appear substantially similar to the assembly 101 illustrated in FIG. 1.

Ring members 124*b* may be used either alone or in combination with the wire rope 124*a*. When used alone, the ring members 124*b* may be installed in a tightly-spaced configuration around the outer surface 127 of the tube member 102 and along a substantial portion of the tube member's length.

To pretension the ring members 124*b*, they may be heated prior to installation and/or the tube 102 may be cooled. By thermally expanding the ring members and/or contracting the tube, a predetermined tension in the ring members 124*b* may be obtained once the assembly 100 reaches its intended operating temperature range.

To improve contact, an optional sheathing layer 126 (see FIG. 2) may be provided between the tube 102 and the reinforcing member 124, e.g., between the tube member and either the wire rope 124*a* or the ring members 124*b*. The sheathing layer 126 may assist in distributing the contact load of the reinforcing member 124 more evenly, i.e., distribute the contact load over interstitial spaces 125. The sheathing layer 126 may be formed from any material capable of withstanding the applied load. For example, various plastic and metal sheeting may be used.

Figure 3:
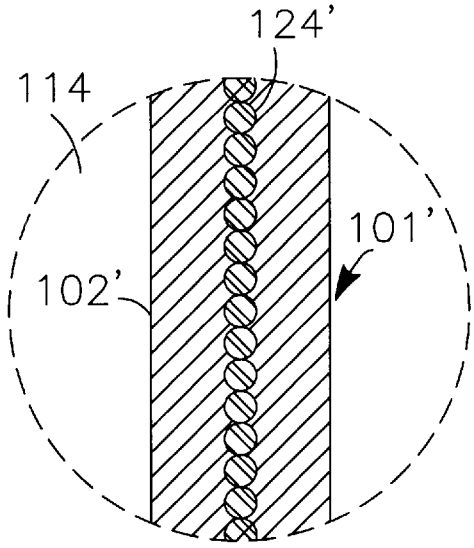
FIG. 3 is a partial, enlarged cross-sectional view of a portion of a column assembly in accordance with yet another embodiment of the invention.

In still yet another embodiment, a cylinder assembly 101' as partially shown in FIG. 3 is provided. The assembly 101' may be a composite assembly having a wire mesh or wire rope element 124' positioned between layers of a compatible material, e.g., metal or plastic, to form a tube 102'. Alternatively, the element 124' may be molded or otherwise formed within the wall of the tube 102'. While functionally equivalent to the embodiments illustrated in FIG. 1 and 2, the embodiment of FIG. 3 provides a column having a more uniform exterior surface, i.e., element 124' is not exposed.

Having described the construction of exemplary column assemblies 100 in accordance with the invention, attention is now directed to exemplary methods of use. Once the cylinder assembly 101 and endcaps 104 and 106 are assembled as generally shown in FIG. 1, a source of filler material (not shown) may be coupled to the assembly 100, e.g., at port 120, and filler material 116 may be transferred into the volume 114. Once again, a bleed port may be provided to allow purging of air as the volume 114 is filled. As the filler material 116 fills the volume 114, the floating endcap 106 may move longitudinally outward, e.g., upwards in FIG. 1. If the optional stop member 108 is provided, the endcap 106 will move until stop surface 112 contacts stop surface 110.

Depending on the size of the particular column assembly 100, it may be advantageous to first place the column assembly in its installed location before filling the volume 114 with filler material 116 (e.g., filler material introduction may be delayed until the column assembly is partially installed). As a result, the assembly 100 may be transported in a relatively lightweight (i.e., sans filler material) configuration. However, in other applications, the assembly 100 may be filled prior to use, e.g., filled on-site or as part of the manufacturing process.

Once the volume 114 is filled, the port 120 and the bleed port may be sealed and the assembly 100 installed for operation. When the installed assembly 100 is subjected to the compressive load 150, the floating endcap 106 pushes against the filler material 116, e.g., fluid, within the volume 114. As the pressure of the filler material 116 increases in response to the compressive load, it produces tangential or circumferential stresses in the wall 115 of the tube assembly 101. These tangential stresses may cause deformation, e.g., expansion, of the tube member 102, thereby increasing the tension in the reinforcing member, e.g., the wire rope 124*a* and/or the ring members 124*b*. However, while the tube member and the reinforcing member are subject to tensile loading, the tube member 102 preferably experiences only minimal compressive loading.

To ensure effective sealing during expansion of the tube member 102, the floating endcap 106 may include a recess 118. The recess 118 permits radial deformation of the lower end of the endcap 106 so that it may expand proportionally with the cylinder assembly 101. By selecting the dimensions of the floating endcap 106, the radial expansion of the floating endcap 106 may be generally matched with that of the cylinder assembly 101. Thus, leakage around the sealing element 117 may be substantially reduced or eliminated. While not shown in the Figures, the endcap 104 may also include a similar recess to prevent leakage at the opposite end of the cylinder assembly 101.

To further ensure effective sealing during use, the tube 102 and endcaps 104 and 106 may be constructed of materials having similar thermal expansion properties. Thus, temperature fluctuations may produce little or no differential expansion.

A pressure-indicating device 130, either local to the assembly 100 or remote, may optionally be included to monitor the pressure within the volume 114. The pressure-indicating device 130 may be used in conjunction with a pressurization control system 132, e.g., a servo-controlled system, to ensure the desired pressure and/or the desired length 129 is maintained.

Column assemblies in accordance with the present invention may therefore resist buckling by transforming the axial column load into internal pressure within the column assembly. The internal pressure may be reacted by tangential stresses developed in the column assembly wall. Accordingly, the column assembly benefits from tensile rather than compressive loading. In some embodiments, the column assembly may include a reinforcing member, e.g., a helically-wound wire rope. The reinforcing member may react at least a portion of the axial compressive load, potentially allowing a further reduction in the thickness of the column assembly wall. As a result, column assemblies constructed in accordance with the present invention may provide increased compressive load-carrying capacity over equivalently-sized columns of conventional construction.

The complete disclosure of the patents, patent documents, and publications cited in the Background, Detailed Description and elsewhere herein are incorporated by reference in their entirety as if each were individually incorporated.

Exemplary embodiments of the present invention are described above. Those skilled in the art will recognize that many embodiments are possible within the scope of the invention. For instance, column assemblies having other cross-sectional shapes, e.g., oval, may be used. Variations, modifications, and combinations of the various parts and assemblies can certainly be made and still fall within the scope of the invention. Thus, the invention is limited only by the following claims, and equivalents thereto.

What is claimed is:

1. A column assembly operable to support a compressive load, the column assembly comprising:

a tube member comprising a first longitudinal end and a second longitudinal end;

a first endcap operable to substantially seal the first longitudinal end of the tube member;

a second endcap operable to substantially seal the second longitudinal end of the tube member, the second endcap longitudinally movable relative to the tube member, wherein the tube member, the first endcap, and the second endcap enclose a volume; and a filler material operable to substantially fill the volume; wherein application of the compressive load across the first endcap and the second endcap results in increased pressurization of the filler material.

2. The column assembly of claim 1, further comprising a reinforcing member circumscribing at least a portion of an outer surface of the tube member.

3. The column assembly of claim 1, wherein the filler material comprises a fluid.

4. The column assembly of claim 1, wherein the filler material comprises a granulated solid.

5. The column assembly of claim 1, wherein the compressive load retains one or both of the first endcap and the second endcap relative to the tube member.

6. A column assembly for supporting a compressive load, the column assembly comprising:

a cylinder assembly, comprising:

a tube member having a longitudinal length and an outer surface; and at least one reinforcing member circumscribing at least a portion of the outer surface of the tube member;

a first endcap adapted to substantially cover a first longitudinal end of the tube member;

a second endcap adapted to substantially cover a second longitudinal end of the tube member, the second endcap longitudinally movable relative to the tube member, wherein the tube member, the first endcap, and the second endcap enclose a volume; and a filler material operable to substantially fill the volume; wherein the filler material is operable to convert at least a first portion of the compressive load into tangential stress within a wall of the tube member.

7. The column assembly of claim 6, wherein the filler material is further operable to convert at least a second portion of the compressive load into tensile stress within the at least one reinforcing member.

8. The column assembly of claim 6, wherein the at least one reinforcing member comprises one or more wire ropes.

9. The column assembly of claim 8, wherein the one or more wire ropes comprises one wire rope helically wound around the at least a portion of the outer surface of the tube member.

10. The column assembly of claim 6, further comprising one or more sealing elements associated with one or both of the first longitudinal end and the second longitudinal end of the tube member.

11. The column assembly of claim 6, further comprising a stop member associated with the second longitudinal end of the tube assembly, the stop member operable to limit movement of the second endcap.

12. The column assembly of claim 11, wherein the stop member comprises a ring secured to the second longitudinal end of the tube member.

13. The column assembly of claim 6, wherein the at least one reinforcing member comprises a mesh element integrally formed with the wall of the tube member.

14. The column assembly of claim 6, wherein the at least one reinforcing member comprises one or more endless ring members.

15. The column assembly of claim 6, further comprising one or more sheathing layers located between the at least one reinforcing member and the tube member.

16. The column assembly of claim 6, wherein the first endcap is fixedly coupled to the tube member.

17. The column assembly of claim 6, wherein the first endcap is longitudinally movable relative to the tube member.

18. The column assembly of claim 6, further comprising an anchoring device operable to secure the reinforcing member relative to the tube member.

19. A method for supporting a compressive load, comprising: providing a column assembly, comprising:

a tube member having an outer diameter and a longitudinal length, the longitudinal length terminated by a first longitudinal end and a second longitudinal end of the tube member;

a reinforcing member surrounding the outer diameter along at least a portion of the longitudinal length;

a first endcap adapted to substantially cover the first longitudinal end of the tube member; and a second floating endcap adapted to substantially cover the second longitudinal end of the tube member, wherein the tube member, the first endcap, and the second floating endcap enclose a volume;

filling the volume with a filler material;

applying the compressive load between the first endcap and the second floating endcap, wherein a pressure of the filler material within the volume is increased;

generating tangential stress in the tube member in response to the increased pressure of the filler material.

20. The method of claim 19, wherein the method further comprises:

expanding the tube member in response to the increased pressure of the filler material; and generating tensile stress in the reinforcing member in response to expanding the tube member.

21. The method of claim 19, wherein the method further comprises pressurizing the filler material to a predetermined level prior to applying the compressive load.

22. The method of claim 19, wherein the method further comprises tensioning the reinforcing member to a predetermined level prior to applying the compressive load.

23. A column assembly for supporting a compressive load, comprising:

a cylindrical tube member having an outer surface and a longitudinal length, the longitudinal length terminated by a first longitudinal end and a second longitudinal end;

a wire rope helically wrapped around the outer surface of the cylindrical tube member over a substantial portion of the longitudinal length;

a first endcap adapted to substantially seal the first longitudinal end of the tube member; and a second endcap adapted to substantially seal the second longitudinal end of the tube member, the second endcap operable to move longitudinally relative to the tube member, wherein the tube member, the first endcap, and the second endcap enclose a volume; and a filler material operable to substantially fill the volume; wherein the filler material is operable to convert at least a first portion of the compressive load into tangential stress within a wall of the tube member and is further operable to convert at least a second portion of the compressive load into tensile stress within the wire rope.

* * * * *